United States Patent [19]

Drury

[11] Patent Number: 4,556,992

[45] Date of Patent: Dec. 10, 1985

[54] PROTECTIVE HAND PAD, AND METHOD OF MAKING SAME

[75] Inventor: Alvin C. Drury, Cincinnati, Ohio

[73] Assignee: Jung Corporation, Cincinnati, Ohio

[21] Appl. No.: 494,821

[22] Filed: May 16, 1983

[51] Int. Cl.[4] ..... A41D 13/08

[52] U.S. Cl. ..... 2/20; 2/169

[58] Field of Search ..... 2/16, 20, 22, 24, 158, 2/161 A, 169, 243

[56] References Cited

U.S. PATENT DOCUMENTS

| | | | |
|---|---|---|---|
| 2,552,177 | 5/1951 | Hurt | 2/24 |
| 3,066,306 | 12/1962 | Thomas | 2/20 |
| 3,189,919 | 6/1965 | Chase | 2/22 X |
| 4,120,052 | 10/1978 | Butler | 2/16 |
| 4,306,315 | 12/1981 | Castiglia | 2/22 |
| 4,344,189 | 8/1982 | Futere et al. | 2/16 |
| 4,484,359 | 11/1984 | Tirinen | 2/169 X |

*Primary Examiner*—Werner H. Schroeder

*Assistant Examiner*—T. Graveline

*Attorney, Agent, or Firm*—Wood, Herron & Evans

[57] ABSTRACT

A protective hand pad fabricated from a sleeve of elastic fabric, and a preformed pad element. The sleeve is initially cut from an endless tube of the elastic fabric. A thumb hole is cut into the sleeve adjacent one end, and the preformed pad element is inserted into the sleeve so the desired outer surface of the pad element is visible through the thumb hole. The sleeve is then stitched to the opposite ends of the pad element along its end edges, as well as along its side edges, so that the pad element is joined to the sleeve but so that the sleeve remains open at both ends. The sewn together sleeve and pad is then turned inside out so that the desired outer surface of the pad element is exposed as an exterior surface of the protective hand pad. In use, a wearer inserts his hand into the sleeve so that the pad element is oriented above or on top of the back of the wearer's hand, and so that the wearer's thumb extends through the thumb hole in the sleeve.

7 Claims, 6 Drawing Figures

FIGURE 1
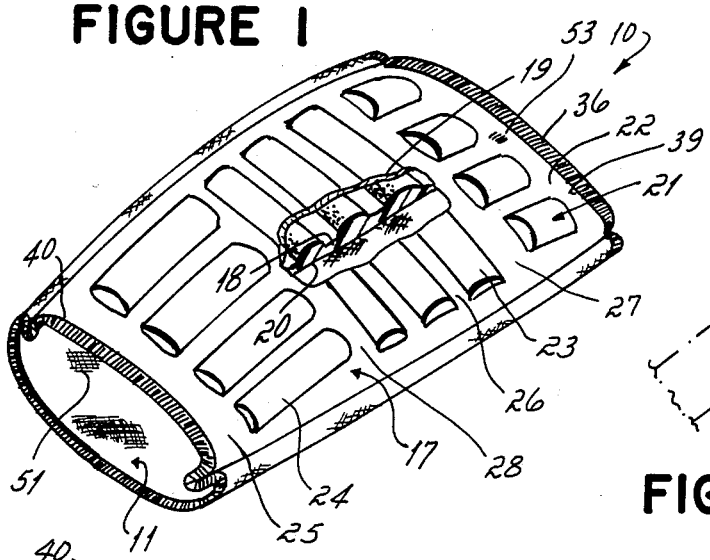
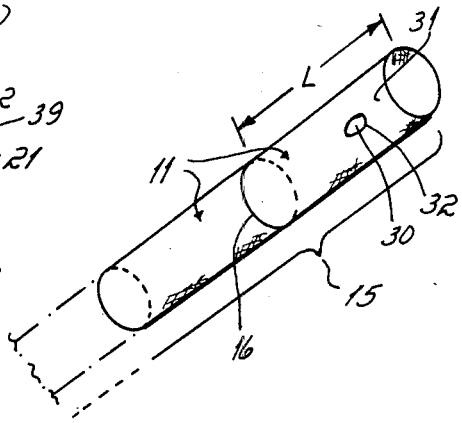
FIGURE 2
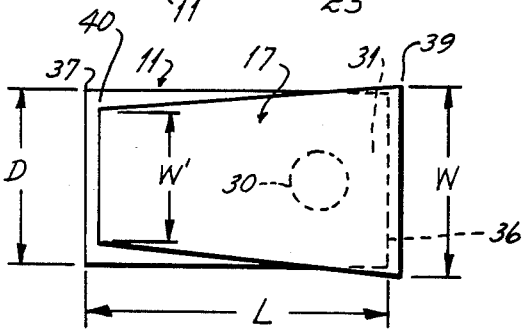
FIGURE 3
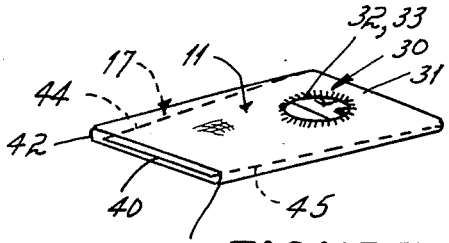
FIGURE 4
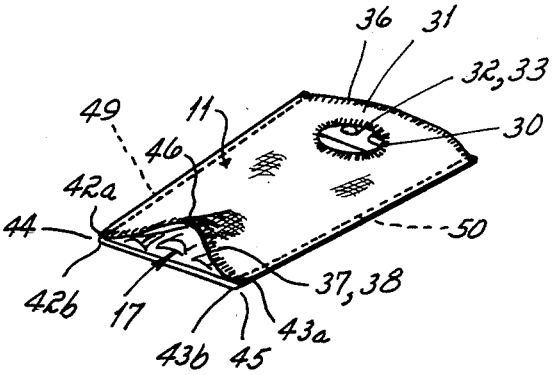
FIGURE 5
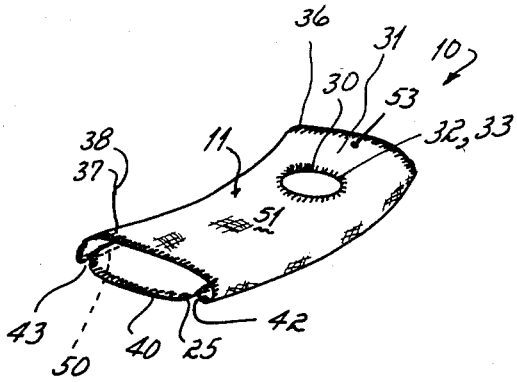
FIGURE 6

PROTECTIVE HAND PAD, AND METHOD OF MAKING SAME

This invention relates to protective pads. More particularly, this invention relates to protective hand pads.

Protective pads for various parts of the human body are, of course, very well known to the prior art. Typical of such protective body pads are protective knee pads, elbow pads, shin pads, hand pads, and the like. Typically, such a protective body pad is provided with a pad element adapted to help protect the body part from exterior blows or scrapes or the like. The pad element itself is connected to an elastic fabric, the elastic fabric cooperating with the pad to hold the pad in desired position on the wearer's body. Many different such prior art protective body pad structures are known to the prior art.

Among the protective pads known to the prior art, as mentioned, is a protective hand pad. Protective hand pads are commonly used, for example, in the game of football. In use, the protective pad element overlies the back of the wearer's hand, thereby helping to protect that side of the wearer's hand from serious injury while the wearer is playing the game. The prior art protective hand pads of which I am aware typically have been fabricated from a series of different component parts. Basically, a protective hand pad includes a hand pad element, and an elastic fabric section stitched to the side edges thereof. The elastic fabric section is provided with a thumb hole adjacent one end of the product to aid in holding the protective hand pad in place on the wearer's hand. It will be appreciated that the more component parts are required in the protective hand pad, the more labor intensive the product is to manufacture and, therefore, the more costly the product is to the end user or consumer.

Accordingly, it has been the objective of this invention to provide a novel protective hand pad, as well as a novel method of making same, which makes use of only two basic component parts, thereby reducing the manufacturing time for the product, as well as reducing the potential product rejects during manufacture, all toward the end objective of providing a hand protective pad that is reliably sturdy in end use and is reasonable in price to the consumer. In accord with this objective, the protective hand pad of this invention is fabricated from a sleeve of elastic fabric, and a preformed pad element. The sleeve is initially cut from an endless tube of the elastic fabric. A thumb hole is cut into the sleeve adjacent one end, and the preformed pad element is inserted into the sleeve so the desired outer surface of the pad element is visible through the thumb hole. The sleeve is then stitched to the opposite ends of the pad element along its end edges, as well as along its side edges, so that the pad element is joined to the sleeve but so that the sleeve remains open at both ends. The sewn together sleeve and pad is then turned inside out so that the desired outer surface of the pad element is exposed as an exterior surface of the protective hand pad. In use, a wearer inserts his hand into the sleeve so that the pad element is oriented above or on top of the back of the wearer's hand, and so that the wearer's thumb extends through the thumb hole in the sleeve.

Other objectives and advantages of the invention will be more apparent from the following detailed description, taking in conjunction with the drawing in which:

FIG. 1 is a perspective view illustrating the protective hand pad of this invention;

FIG. 2 illustrates a first step in making the protective hand pad of this invention;

FIG. 3 is a top plan view illustrating the two basic component parts of the protective hand pad of this invention, one being separate or unassembled with the other, and one overlying the other;

FIG. 4 illustrates an intermediate step in assembling the protective hand pad of this invention;

FIG. 5 illustrates another intermediate step in assembling the protective hand pad of this invention; and FIG. 6 illustrates the final step in making the protective hand pad of this invention.

The protective hand pad 10 in accord with the principles of this invention is basically made of only two components, namely, an elastic fabric sleeve 11, and a premolded pad element 17. It is the fact that the protective hand pad 10 is made from only two components that results in the advantages of the protective hand pad product.

The first component of the protective hand pad 10, which is the elastic sleeve 11, is initially cut to length, as at 16, from an endless tube 15 of elastic fabric, see FIG. 2. The endless tube of fabric is a woven fabric of polyester or nylon knit yarns with rubber or other elastomeric yarns laid in that knit to provide a stretchable fabric with good return or memory characteristics. Such fabrics are well known to the prior art and, per se, form no part of this invention. But an integral part of this invention is the fact that the sleeve 11 component of the two component protective hand pad 10 is initially cut to length L in the manufacturing sequence from an endless length of an elastic woven fabric tube 15 as shown in FIG. 2.

The second component of the two component protective hand pad 10 is in the form of a preformed pad element 17. The preformed pad element 17 is formed from a closed cell molded foam body 18 and an abrasive resistant cloth 19 laminated to the foam body 18. The abrasive resistant cloth 19 may be a woven or knit fabric of nylon or polyester threads. In its preformed state, and prior to assembly into the protective hand pad product of this invention, the bottom surface 20 of the preformed pad element 17 is a flat surface. In manufacture, the preformed pad element 17 is molded into that configuration shown in FIG. 1 which includes a series of longitudinally disposed finger ribs 21 adjacent the finger end edge 22 of that pad element, a series of laterally disposed hand ribs 23 disposed centrally of the element, and a series of longitudinally disposed protective ribs 24 located adjacent the wrist end edge of the element. The lateral valleys 26 between the lateral hand ribs 23, and the lateral valleys 27, 28 between the group of lateral hand ribs 23 and the group of finger ribs 21, and between the lateral hand rib 23 group and the group of protective ribs 24, respectively, enhances the flexibility of the pad element 12 when the protective hand pad 10 is in use. This pad element 17 is a preformed element which is formed by molding the closed cell foam body 18 and cloth fabric 19 into the desired configuration.

As to the sleeve 10 a thumb hole 30 is cut out of the sleeve adjacent the finger end edge 31 of that sleeve. If desired, the endless length elastic fabric tube 15 can be die cut to desired sleeve length L, and the thumb hole 30 can be die cut out of that tube, simultaneously in order to form the sleeve 10 component. Alternatively, of course, the sleeve 10 can be cut to length L from the endless tube 15, and the thumb hole 30 thereafter cut into the sleeve as a separate step. After the thumb hole 30 is cut into the sleeve 10, the peripheral edge 32 of the thumb hole is stitched, preferably by serging or heavily binding that edge 32 with a tight close stitch as shown at 33. Such a tight close stitch builds up a smooth finished binding around the thumb hole's peripheral edge 32. This not only makes the periphery 32 of the thumb hole 30 acceptable in feel to the wearer of the protective hand pad 10, but is also prevents unraveling or pull back of the elastic yarn, as well as of the non-elastic yarn, from which the elastic sleeve 11 is fabricated. The serging or binding of the thumb hole 30 in the cut-to-length sleeve 11 preferably is accomplished prior to insertion of the hand pad element 17 into the sleeve.

Note particularly, as shown in the top plan view of FIG. 3, that the hand pad element 17 is of a generally trapezoid or truncated configuration (and, as shown, is an isosceles trapezoid) prior to assembly into the final protective hand pad product 10. More specifically, the wide base or finger end edge 22 of the hand pad element 17 is of a width W greater than the diameter D of the separate sleeve 11 as cut, and the narrow or wrist end edge 25 of the hand pad element is of a width W' less than the diameter D of the elastic sleeve as cut. This dimensional and structural relation of the two components 11, 17 aids in manufacture of the final protective hand pad product in that the pad element is resiliently held in a desired position within the sleeve during subsequent sewing steps. Also, this dimensional and structural relation of the two components induces a degree of transverse curvature to the pad element during manufacture which it retains after assembly in the final product, the curvature being desirable in the final product to enhance the fit of the pad around a user's hand.

The preformed pad element 17 is thereafter inserted into the sleeve 11 in a specific orientation as shown in FIG. 4. The orientation is such that the wide end or finger end edge 22 of the pad element 12 is oriented adjacent that end edge 31 of the sleeve 10 which incorporates the thumb hole 30. Further in this regard, the pad element 12 is inserted into that elastic sleeve 10 in such orientation that the ribbed face 21, 23, 24 of the pad element, i.e., the face covered by the abrasive resistant cloth fabric 19, is visible through the tube's thumb hole 30. This is an important orientation of the pad element 17 within the sleeve 10 in order to produce the final protective hand pad product 10 in the desired structural configuration.

Subsequently, the edges 36, 37 of the two opposed ends 31, 38 of the sleeve are tightly stitched or serged or bound to the end edges 39, 40 of the pad 17. This serging or binding of the end edges of the sleeve tends to prevent unraveling and pull back of the elastic yarns from which the sleeve is knitted, as well as of the non-elastic yarns from which it is knitted. Further in this regard, the serging or binding of the end edges 36, 37 of the sleeve 10 provides a relatively smooth finish for the end edges 39, 40 of the protective hand pad 10 since those ends will be accessible to touch by the wearer of the pad.

It is important to note that the serging or binding of the sleeve's end edges 36, 37 is done in such fashion that the sleeve 11 remains open at both ends, yet also in such fashion that the finger end edge 22 and wrist end edge 25 of the pad element 17 is bound to the respective end edges 36, 37 of the elastic sleeve 11, too. In other words, the finger end edge 22 of the pad element 17 is stitched to approximately one-half the peripheral length of the thumb edge 36 of the sleeve 11 as that sleeve's thumb edge is bound or serged to provide a smooth finish binding therearound. Similarly, the wrist end edge 25 of the pad element 17 is stitched to about one-half the peripheral length of the wrist end edge 37 of the sleeve 11 when the wrist end edge of that sleeve is serged or bound to provide a smooth finished binding therearound. The important aspect of this step, however, is that after the serging or binding of the sleeve's thumb end 36 and wrist end 37 edges, respectively, which stitching step connects the finger end 22 and wrist end 25 edges of the pad element 17 to the sleeve 11, too, there is still an opened ended sleeve type intermediate product. The side edges 42, 43 of the sleeve 11 in the intermediate product shown in FIG. 4 are thereafter lapped over the opposite side edges 44, 45 of the pad element as shown in FIG. 5. This establishes a double thickness sleeve edge **42*a*, 42*b* or 43*a*, 43*b* on each side of the pad element 12 with the pad element's associated side edge 44 or 45, this associated side edge being in effect sandwiched between the sleeve's doubled over thickness. Prior to the sleeve's side edges 42, 43 being stitched to the pad element's side edges, and if desired, that portion the sleeve's wrist end 38 not stitched to the pad element 17 may be gathered as shown at 46 so that the sleeve's side edges 42, 43 are drawn against the pad element's side edges 44, 45. Alternatively, no such gathering need be done. Subsequently, a stitch line 49, 50 is run down each of the opposed lapped side edges 42, 44, and 43, 45 of the trapezoid configured pad element 17 so that both the front and back faces of the sleeve 11** are positively stitched to both the front and back face of the pad element at the opposite side edges of that pad element.

Once the stitching steps are accomplished to form the intermediate protective hand product shown in FIG. 5, that intermediate product is then turned inside out. In other words, the intermediate protective hand product shown in FIG. 5 is turned inside out so that the abrasive resistant cloth face 19 of the pad element 17 constitutes the outside face of one side of the protective hand pad, and so that the inside face section 51 of the sleeve 11 (as shown in FIG. 5) becomes the outside face section of the sleeve 11 in the final protective hand pad product shown in FIG. 1. Thus, the final protective hand pad product presents the abrasive resistant cloth face 19 of the pad element as one face of the final protective hand pad 10, and the elastic sleeve section 51 is the other face of the pad product, the elasticity of the elastic sleeve permitting the pad to be retained in position on the user's hand. Also, note particularly that the stitch lines 49, 50 by which the side edges 44, 45 of the hand pad element 17 are stitched to the sleeve are interior or inside stitch lines not exposed to abrasion during use of the protective hand pad. And note further that the pad element 17 is stitched along its side edges to a double thickness of the sleeve as shown in FIG. 5 for enhancing the strength of that stitched connection between preformed pad element and sleeve.

After the FIG. 5 intermediate product is turned inside out as shown in FIG. 6, the pad element 17 is then tack sewn if desired to the sleeve section 51 along the finger end edge 22, 31 thereof at a single position 53. This tack 53 type connection of the pad element 17 with the elastic sleeve section 51 of the pad 10 in effect defines a finger stall that is positionable between the second and third fingers of a user's hand when the protective hand pad is worn. The finger stall so created, in combination with the pad's thumb hole 30, cooperates to prevent the protective hand pad 10 from sliding toward the user's wrist, i.e., from sliding up the wearer's arm while the pad is being worn.

Having described my invention in detail, what I desire to claim and protect by Letters Patent is:

1. A method of fabricating a protective pad, said method comprising the steps of cutting a predetermined length elastic sleeve from an endless length of an elastic woven fabric tube as a first component, providing a preformed pad element as a second component, inserting said preformed pad element into said elastic sleeve, stitching the opposed end edges of said pad element to said elastic sleeve, and stitching the opposed side edges of said pad element to said elastic sleeve, so that said pad element and said sleeve together define an intermediate product having a generally tubular configuration open at both ends, and thereafter turning said intermediate product inside out to provide a finished protective pad product.

2. A method of fabricating a protective pad as set forth in claim 1, said method comprising the further step of stitching one thickness of said sleeve to one face of said pad element, and stitching another thickness of said sleeve to an opposite face of said pad element, along each side edge of said pad element, thereby sandwiching the side edges of said pad element between double thickness of said sleeve.

3. A protective pad product formed in accord with the method of Claim 1.

4. A method of fabricating a protective hand pad as set forth in claim 1, said method comprising the further step of providing a thumb hole in said elastic sleeve adjacent the finger end edge of said sleeve, the outside surface of said pad element being visible through said thumb hole during the stitching steps by which said pad element's side edges are sewn to said sleeve.

5. A method of fabricating a protective hand pad as set forth in claim 4, said method comprising the further step of forming said pad element of a generally trapezoid pyramid configuration, so that, prior to stitching of said pad element to said sleeve, the finger end edge of said pad element is wider than the diameter of said sleeve, and the wrist end of said pad element is narrower than the diameter of said tube, said pad element thereby being provided with at least a nominal curvature adjacent the finger end thereof when assembled into the protective hand pad.

6. A method of fabricating a protective hand pad as set forth in claim 4, said method comprising the further step of serging both end edges of said elastic sleeve, said serging step also serving to connect said pad element's end edges to said sleeve's end edges.

7. A protective hand pad product formed in accord with the method of claim 4.

* * * * *